US011549296B2

(12) United States Patent
Bucklin et al.

(10) Patent No.: US 11,549,296 B2
(45) Date of Patent: Jan. 10, 2023

(54) TEMPERATURE ACTIVATED DOOR SPRING

(71) Applicants: J. D. Bucklin, Olympia, WA (US); Michelle Lynn Bucklin, Olympia, WA (US)

(72) Inventors: J. D. Bucklin, Olympia, WA (US); Michelle Lynn Bucklin, Olympia, WA (US)

( * ) Notice: Subject to any disclaimer, the term of this patent is extended or adjusted under 35 U.S.C. 154(b) by 414 days.

(21) Appl. No.: 16/675,745

(22) Filed: Nov. 6, 2019

(65) Prior Publication Data

US 2020/0173213 A1 Jun. 4, 2020

Related U.S. Application Data

(60) Provisional application No. 62/757,038, filed on Nov. 7, 2018.

(51) Int. Cl.

| | |
|---|---|
| ***E05F 1/00*** | (2006.01) |
| ***E05F 1/12*** | (2006.01) |
| ***E05B 65/10*** | (2006.01) |

(52) U.S. Cl.

CPC ..... *E05F 1/006* (2013.01); *E05B 65/104* (2013.01); *E05F 1/1207* (2013.01); *Y10T 16/22* (2015.01)

(58) Field of Classification Search

CPC ..... E05F 1/006; E05F 1/1207; E05F 15/72; E05B 65/104; Y10T 16/22

See application file for complete search history.

(56) References Cited

U.S. PATENT DOCUMENTS 1,925,386 A * 9/1933 Hurd ..... A62C 2/242 16/48.5
2,859,842 A * 11/1958 Schlage ..... A62C 2/12 16/48.5
2,901,064 A * 8/1959 Lasier ..... A62C 2/12 16/48.5
2,954,106 A * 9/1960 Schlage ..... A62C 2/12 16/48.5
3,094,200 A * 6/1963 Schlage ..... E05F 3/221 16/48.5
3,147,830 A * 9/1964 Flint ..... E05F 3/221 16/48.5
3,777,422 A * 12/1973 Janssen ..... F24F 7/02 49/7
3,779,004 A * 12/1973 Gloeckler ..... F16G 15/00 59/93
3,905,063 A * 9/1975 Coulter ..... A62C 2/12 16/48.5

(Continued)

*Primary Examiner* — Justin B Rephann

(57) ABSTRACT

A temperature activated door spring device includes a spring having a coil with a contiguous upper arm and lower arm. The coil includes an inner hinge pin hole and has a circumferential edge sized to mount on the top of a hinge knuckle. A collar is affixed within the inner hinge pin hole wherein the inner hinge pin hole is encompassed by the collar sized to accept an inserted hinge pin. A pellet hole is located proximate an extended end of the upper arm, wherein the pellet hole is sized to accept a fusible pellet. An upper portion of the pellet hole traverses through the upper arm and a lower portion of the pellet hole traverses through the lower arm so that when a fusible pellet is inserted into the pellet hole it holds the upper arm and the lower arm together in a spring loaded position.

20 Claims, 9 Drawing Sheets

(56) References Cited

U.S. PATENT DOCUMENTS

| | | | | | |
|---|---|---|---|---|---|
| 3,983,599 | A * | 10/1976 | Takashiro | E05F 3/221 | 16/48.5 |
| 4,161,804 | A * | 7/1979 | D'Hooge | A62C 2/12 | 16/48.5 |
| 4,324,425 | A | 4/1982 | Logan | | |
| 4,414,777 | A | 11/1983 | Masacchia | | |
| 4,726,613 | A | 2/1988 | Foshee | | |
| 4,884,832 | A | 5/1989 | Bungard | | |
| 5,061,022 | A | 10/1991 | Meriwether | | |
| 5,121,950 | A | 6/1992 | Davidian | | |
| 5,380,053 | A | 1/1995 | Saino | | |
| 5,427,420 | A | 6/1995 | Moore | | |
| 5,492,208 | A | 2/1996 | Goossens | | |
| 5,551,187 | A | 9/1996 | Brouwer | | |
| 5,690,371 | A | 11/1997 | Turnbull | | |
| 5,709,009 | A * | 1/1998 | Lasson | A62C 2/241 | 16/48.5 |
| 5,782,509 | A | 7/1998 | Uyeda | | |
| 6,092,334 | A * | 7/2000 | Kim | E05F 1/006 | 49/8 |
| 6,615,544 | B1 | 9/2003 | Tlemcani et al. | | |
| 7,028,431 | B2 | 4/2006 | Tlemcani et al. | | |
| 7,488,012 | B2 | 2/2009 | Eller et al. | | |
| 8,844,195 | B2 | 9/2014 | Cox et al. | | |
| 8,955,194 | B2 | 2/2015 | Teta et al. | | |
| 8,979,143 | B1 | 3/2015 | Lin | | |
| 9,290,964 | B2 | 3/2016 | Trent et al. | | |
| 9,799,462 | B2 | 10/2017 | Feil et al. | | |
| 11,053,722 | B2 * | 7/2021 | Teta | E05D 3/02 | |
| 11,072,964 | B2 * | 7/2021 | Teta | E05F 1/006 | |
| 2004/0045219 | A1 | 3/2004 | Tlemcani et al. | | |
| 2011/0271484 | A1 | 11/2011 | Irwin | | |
| 2013/0247329 | A1 * | 9/2013 | Teta | E05F 1/006 | 16/48.5 |

* cited by examiner

TEMPERATURE ACTIVATED DOOR SPRING

TECHNICAL FIELD

The present invention relates to safety door hinge pin springs, and, more particularly, to a temperature activated door spring for promoting fire safety.

BACKGROUND

According to a September 2017 report from the National Fire Protection Agency (NFPA) U.S. fire departments responded to an estimated average of 358,500 home structure fires per year during 2011-2015. These fires caused an average of 2,510 civilian deaths, 12,300 civilian injuries, and $6.7 billion in direct property damage per year. Seventy percent of reported home fires and 84% of the home fire deaths occurred in one- or two-family homes. The remainder occurred in apartments or other multi-family housing. Estimates were derived from the U.S. Fire Administration's National Fire Incident Reporting System (NFIRS) and the National Fire Protection Association's fire department experience survey. (NFPA, "Home Structure Fires," 2017).

Further, according to the same report, Home fire deaths occur more often in cooler months and between 11:00 p.m. and 7:00 a.m. In 2011-2015, 47% of home structure fires and 56% of home structure fire deaths occurred in the five months of November through March. Reported home fires peaked around the dinner hours of 5:00 to 8:00 p.m. While just one-fifth (20%) of reported home fires occurred between 11:00 p.m. and 7:00 a.m., half (52%) of the home fire deaths resulted from fires reported during these hours (Id).

As is known by fire-fighting professionals and fire departments, having a bedroom door closed can protect belongings inside even when temperatures reach 1,000 degrees. Having one's door closed can make a 900 degree difference in a fire. As a result having a door that automatically closes can be a life saver. While fire doors are required to separate a living space from a garage, for example, standard fire doors are kept in the closed position unless propped open (which is not recommended). For bedrooms and other interior rooms of a home it would be desirable to have the option of keeping a door open without the need for a door jam or the like.

Such devices are available, but have several drawbacks. For example, U.S. Pat. No. 8,955,194 issued Feb. 17, 2015 to Teta teaches a closure mechanism for a door actuated during a fire, which causes the door to automatically close. However, Teta teaches a mechanism that requires replacement of an entire hinge with a new hinge that includes a spring mechanism within the hinge. As a result, it is cumbersome to install since the entire hinge must be replaced and it requires a fairly complex set of internal parts.

In order to overcome the drawbacks of the prior art, the disclosure herein describes a closure mechanism for a door that is actuated during a fire. The closure mechanism automatically closes the door. Installation of the closure mechanism is easily accomplished by placing it on an existing door hinge and holding it in place by a hinge pin.

BRIEF SUMMARY OF THE DISCLOSURE

This summary is provided to introduce, in a simplified form, a selection of concepts that are further described below in the Detailed Description. This summary is not intended to identify key features of the claimed subject matter, nor is it intended to be used as an aid in determining the scope of the claimed subject matter.

Disclosed herein is a temperature activated door spring device including a spring having a coil, an upper arm and a lower arm contiguous with the coil. The coil includes an inner hinge pin hole and has a circumferential edge sized to mount on the top of a hinge knuckle. A collar is affixed within the inner hinge pin hole wherein the inner hinge pin hole is encompassed by the collar and is sized to accept an inserted hinge pin. A pellet hole is located proximate an extended end of the upper arm, wherein the pellet hole is sized to accept a fusible pellet. An upper portion of the pellet hole traverses through the upper arm and a lower portion of the pellet hole traverses through the lower arm so that when a fusible pellet is inserted into the pellet hole it holds the upper arm and the lower arm together in a spring loaded position.

BRIEF DESCRIPTION OF THE DRAWINGS

While the novel features of certain embodiments of the invention are set forth with particularity in the appended claims, the invention, both as to organization and content, will be better understood and appreciated, along with other objects and features thereof, from the following detailed description taken in conjunction with the drawings, in which:

FIG. 11 is a table listing various fusible metals useful for making the fusible pellet.

Figure 1:
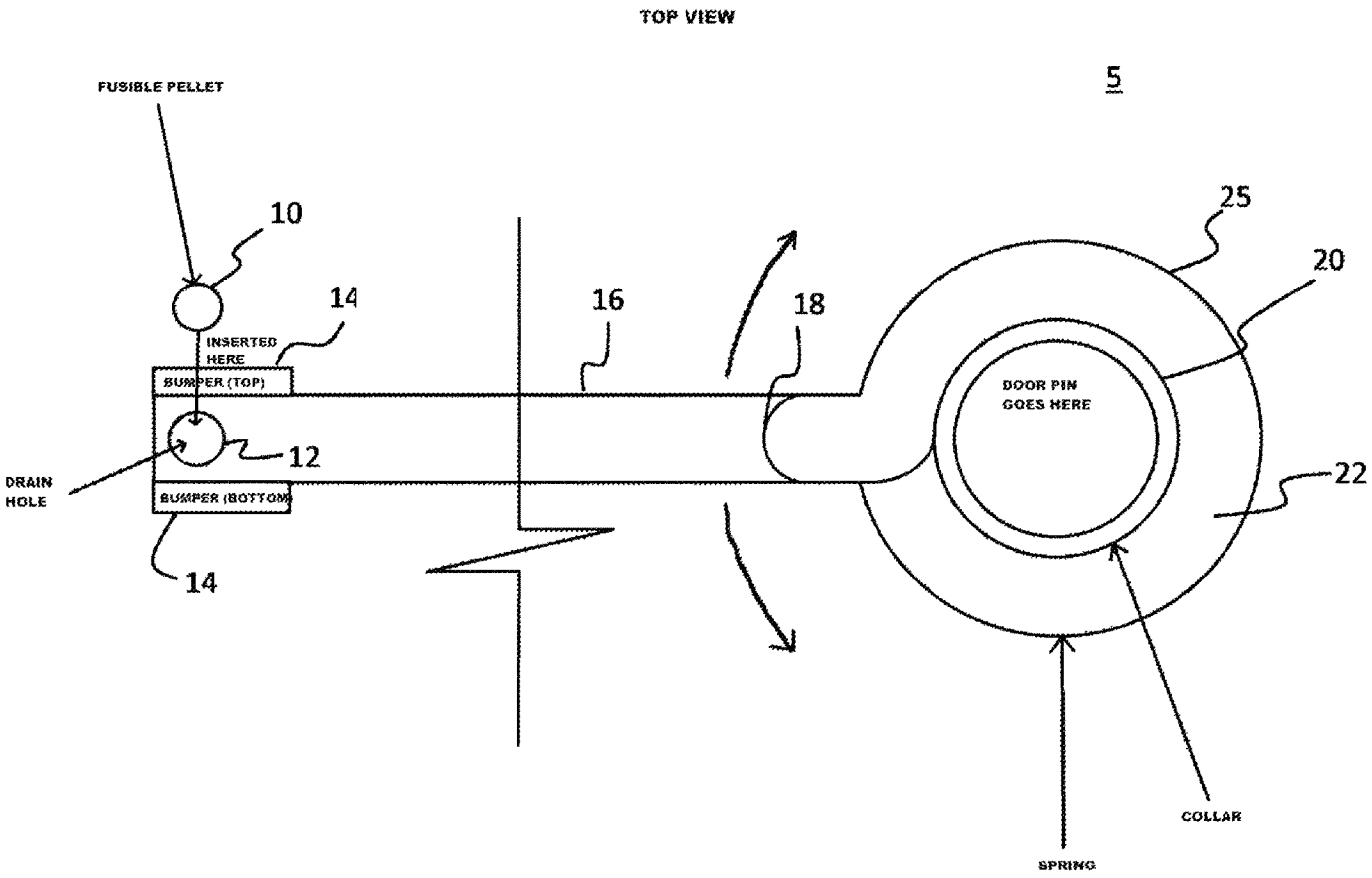
FIG. 1 schematically illustrates a top view of one example of a temperature activated door spring.

In the drawings, identical reference numbers identify similar elements or components. The sizes and relative positions of elements in the drawings are not necessarily drawn to scale. For example, the shapes of various elements and angles are not drawn to scale, and some of these elements are arbitrarily enlarged and positioned to improve drawing legibility. Further, the particular shapes of the elements as drawn, are not intended to convey any information regarding the actual shape of the particular elements, and have been solely selected for ease of recognition in the drawings.

DETAILED DESCRIPTION

The following disclosure describes an apparatus for a safety door hinge pin spring. Several features of methods and systems in accordance with example embodiments are set forth and described in the figures. It will be appreciated that methods and systems in accordance with other example embodiments can include additional procedures or features different than those shown in the figures. Example embodiments are described herein with respect to temperature activated spring hinges having a pair of spring activated closure arms. However, it will be understood that these examples are for the purpose of illustrating the principles, and that the invention is not so limited.

Unless the context requires otherwise, throughout the specification and claims which follow, the word "comprise" and variations thereof, such as, "comprises" and "comprising" are to be construed in an open, inclusive sense that is as "including, but not limited to."

Reference throughout this specification to "one example" or "an example embodiment," "one embodiment," "an embodiment" or combinations and/or variations of these terms means that a particular feature, structure or characteristic described in connection with the embodiment is included in at least one embodiment of the present disclosure. Thus, the appearances of the phrases "in one example" or "in an embodiment" in various places throughout this specification are not necessarily all referring to the same embodiment or example. Furthermore, the particular features, structures, or characteristics may be combined in any suitable manner in one or more embodiments.

Definitions

Generally, as used herein, the following terms have the following meanings:

The articles "a" or "an" and the phrase "at least one" as used herein refers to one or more.

As used herein, "plurality" is understood to mean more than one. For example, a plurality refers to at least two, three, four, five, ten, 25, 50, 75, 100, 1,000, 10,000 or more.

"Obtaining" is understood herein as manufacturing, purchasing, or otherwise coming into possession of.

Referring now to FIG. 1, a top view of one example of a temperature activated door spring is schematically illustrated. A temperature activated door spring 5 includes a spring 22 having a contiguous upper arm 16 with a pellet hole 12 proximate the end of the upper arm 16. The pellet hole 12 is sized to accept a fusible pellet 10. The upper arm 16 has a first bumper 14 attached proximate the end. A second bumper 14 is attached to a contiguous lower arm 17 as illustrated in FIG. 2.

Figure 2:
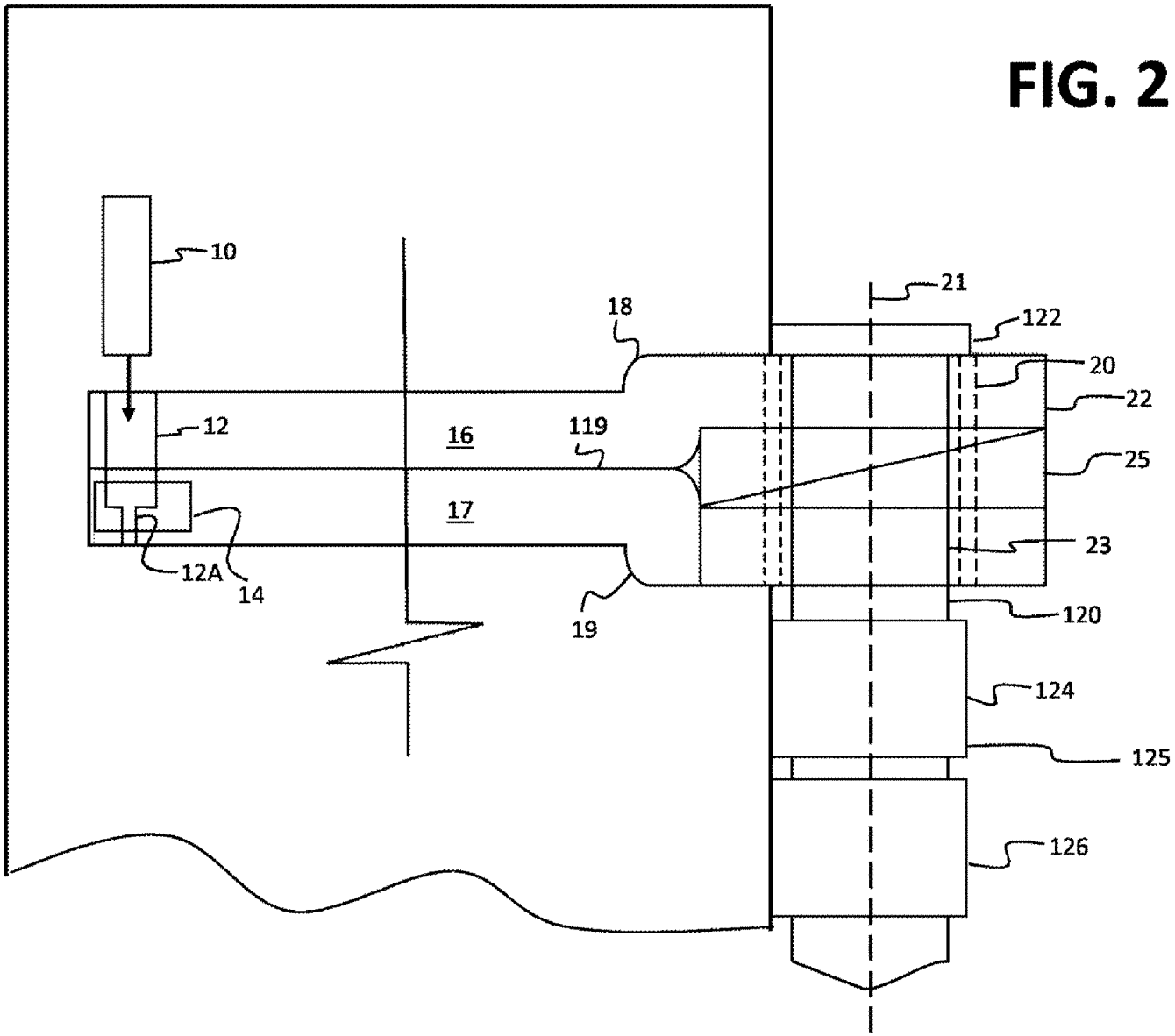
FIG. 2 schematically illustrates a side view of one example of a temperature activated door spring.

Referring now to FIG. 2, a side view of one example of a temperature activated door spring is schematically illustrated. The spring 22 includes a coil 25. Coil 25 is constructed to form upper arm 16 at a top end and a lower arm 17 at a bottom end. The upper arm 16 and the lower arm 17 are elongated in a direction generally at a right angle to a central axis 21 projected through the center of the collar 20. Both arms include a shoulder, 18, 19 respectively shape to allow the upper and lower arms to substantially abut each other along an interior surface 119. Coil 25 includes a hinge pin hole 23 around which the spring is coiled. A collar 20 is affixed within the pin hole 23. The hinge pin hole 23 is encompassed by the collar 20 and is sized to accept an inserted hinge pin 120. The hinge pin 120 includes a top 122 where the top 122 has a diameter larger than the diameter of the collar 20. In this way the hinge pin 120 is held from falling through the hinge pin hole 23.

Still referring to FIG. 2, the lower arm 17 includes a lower bumper 14 attached proximate the end of the lower arm 17. The pellet hole 12 includes a drain hole 12A in a lower portion. A portion of the pellet hole 12 traverses through the upper arm 16 and a lower portion of the pellet hole 12 including the drain hole 12A traverses partially through the lower arm 17 when the upper arm and lower arm are aligned in a locking position. As shown by the downward pointing arrow, when the fusible pellet 10 is inserted into the pellet hole 12 it holds the upper arm 16 and the lower arm 17 together in a closed mode. In one example, the pellet hole 12 may include a narrower portion 12A forming a seat for holding the fusible pellet while still allowing for drainage. When installed into a door hinge 125, the hinge pin 120 engages the temperature activated door spring 5 with the hinge 125 when inserted into knuckles 124, 126 which form part of the hinge. It will be recognized that a hinge can have more than 2 such knuckles and it is intended that the hinge pin is long enough to engage all of the knuckles on most door hinges. When installed, the upper and lower arms will be located proximate to one side of a door 7.

Figure 3:
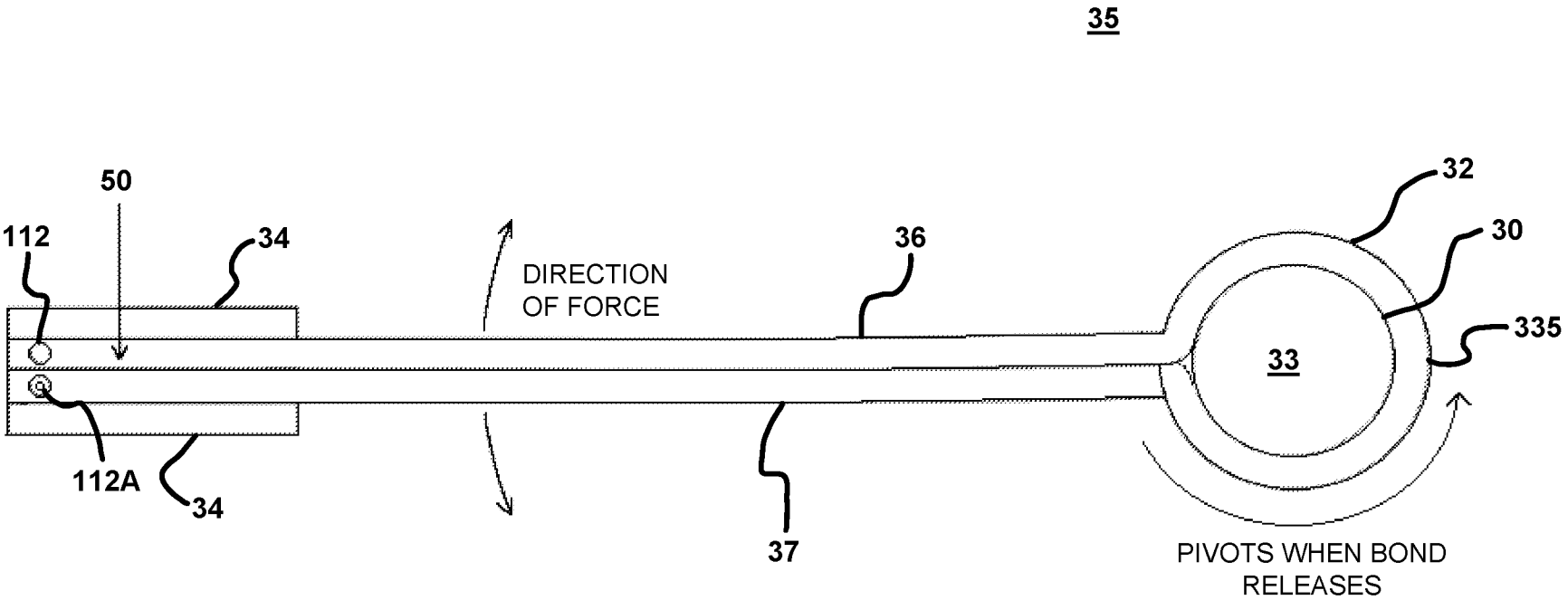
FIG. 3 schematically illustrates a top view of an alternate example of a temperature activated door spring in a loaded position.

Referring now to FIG. 3, a top view of an alternate example of a temperature activated door spring is schematically illustrated. A temperature activated door spring 35 includes a spring 32 having a contiguous upper arm 36. The upper arm 36 has a first bumper 34 attached proximate the end. A second bumper 34 is attached to a contiguous lower arm 37. The spring 32 includes a coil 335. Coil 335 is constructed to form the upper arm 36 at a top end and the lower arm 37 at a bottom end. Coil 335 includes an inner pin hole 33 around which the spring is coiled. A fusible bond 50 is affixed to the upper arm 36 and lower arm 37 to hold them together in a loaded position until the ambient temperature reaches the melting point of the fusible bond 50. In an alternate embodiment, a fusible pellet may be shaped to be inserted into pin holes 112 and 112A to join the upper and lower arms in place of the fusible bond 50.

Figure 4:
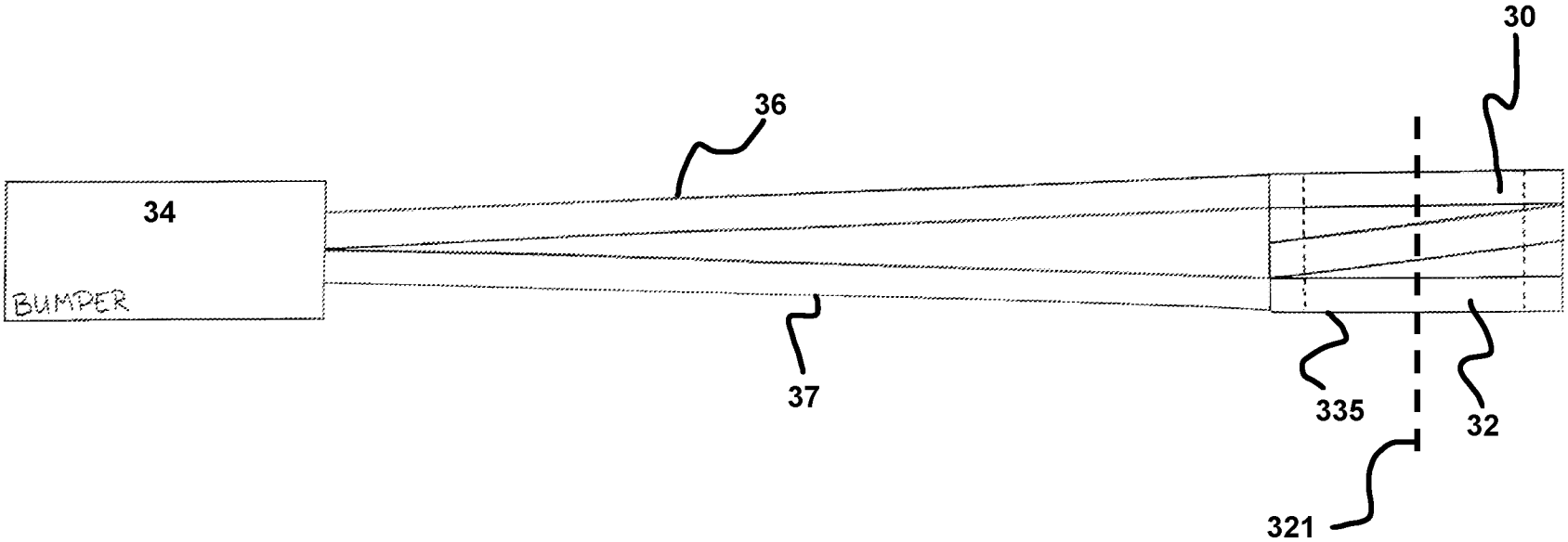
FIG. 4 schematically illustrates a side view of the alternate example of FIG. 3 of a temperature activated door spring in a loaded position.

Referring now to FIG. 4, a side view of an alternate example of FIG. 3 of a temperature activated door spring is schematically illustrated in a loaded position. The upper arm 36 and the lower arm 37 are elongated in a direction generally at a right angle to a central axis 321 projected through the center of the collar 30. The upper arm 36 and lower arm 37 each include a bumper 34 attached to an outside edge at an end opposite the coil end. The upper arm 36 and the lower arm 37 are angled toward each other to meet at the bumper end and are most separated at the coil end of the spring.

Figure 5:
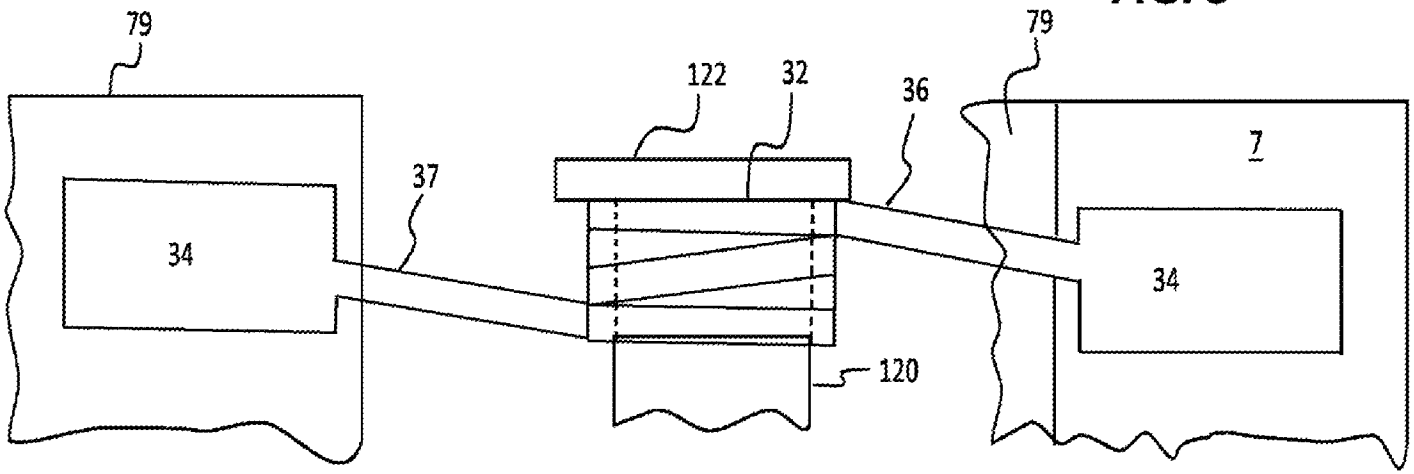
FIG. 5 schematically illustrates a side view of the alternate example of FIG. 3 of a temperature activated door spring after activation.

Referring now to FIG. 5, a side view of the alternate example of FIG. 3 of a temperature activated door spring after activation is schematically illustrated. In this example a hinge pin 120 including pinhead 122 has been inserted into the temperature activated door spring. Ambient temperature conditions would be such that the bond 50 has already melted. Here the upper and lower arms 36, 37 respectively are shown with the temperature activated door spring in the activated position. In one example, upper spring arm 36 bears with a spring force against a door 7, which is attached to the same hinge as the hinge pin, and lower arm 37 applies an opposing spring force against a doorjamb 79 thereby causing the door to close.

Figure 6:
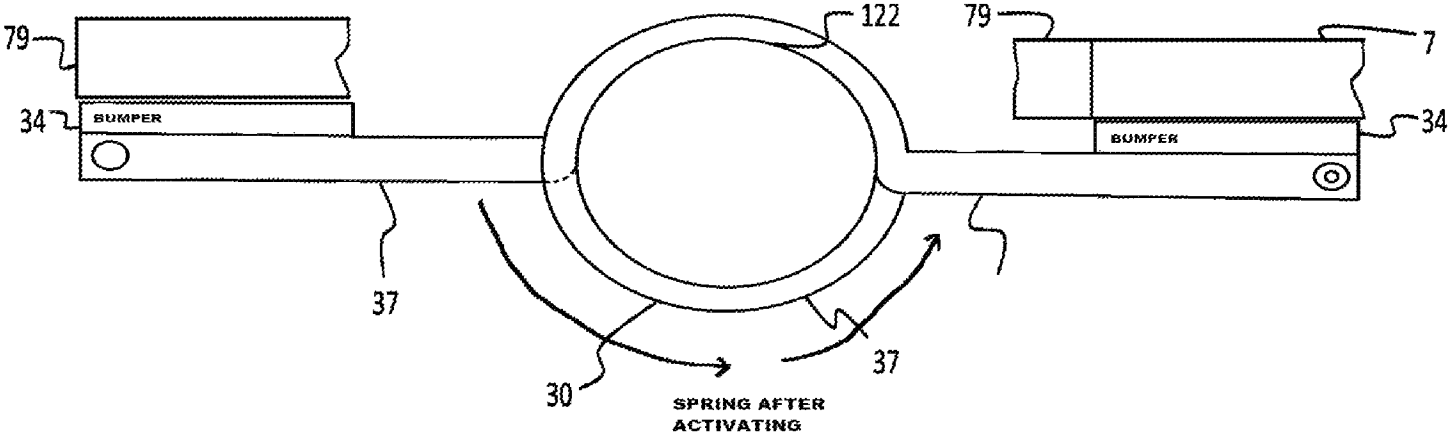
FIG. 6 schematically illustrates a top view of the alternate example of a temperature activated door spring of FIG. 3 after activation.

Referring now to FIG. 6, a top view of the alternate example of the temperature activated door spring of FIG. 3 after activation is schematically illustrated. Here it can be seen that the door 7 is substantially in line with frame 79 in a closed position. The closed position as a result of the upper spring arm and lower spring arm applying opposing force between the hinge and door.

Figure 7:
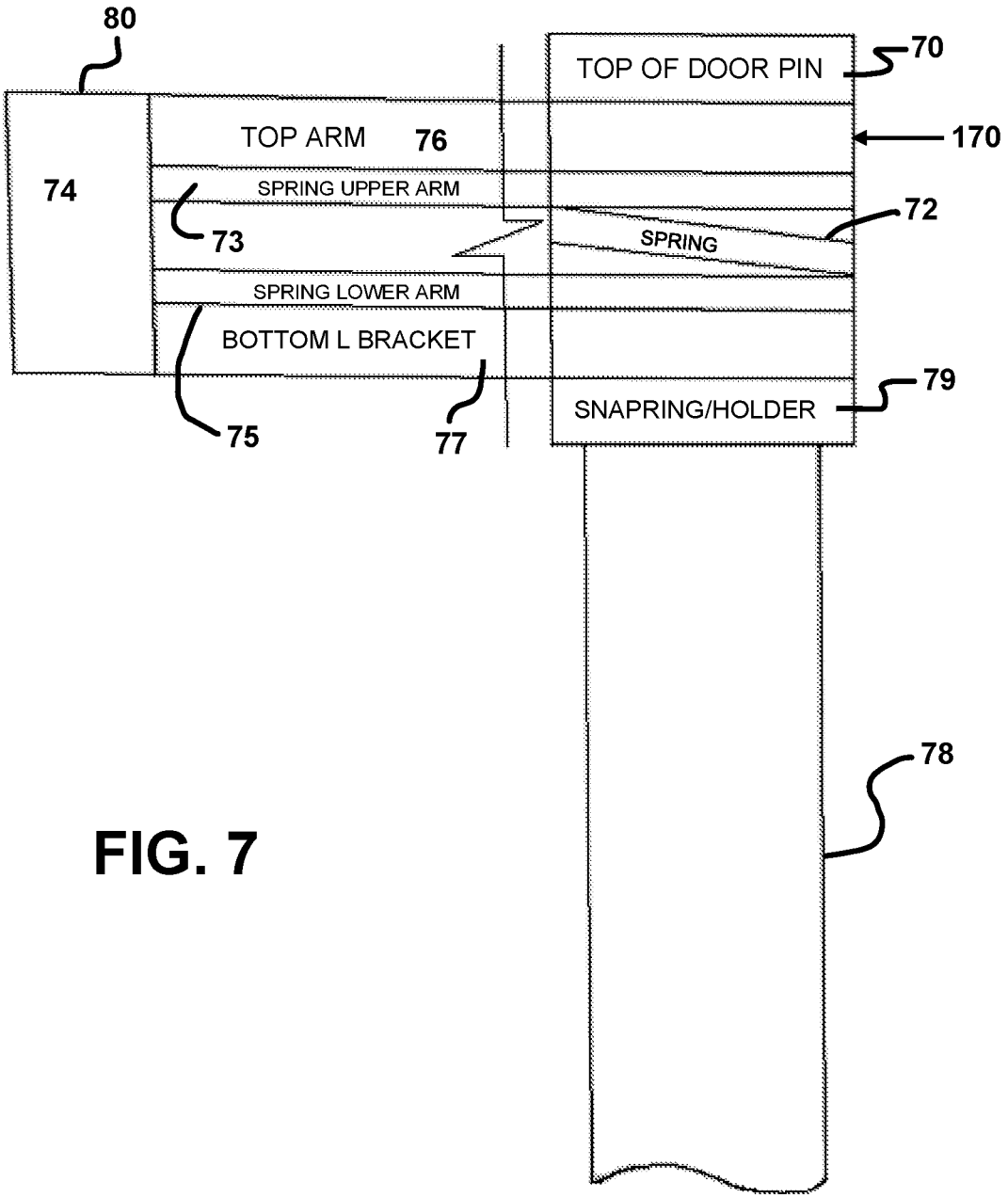
FIG. 7 schematically illustrates a side view of another alternate example of a temperature activated door spring as installed with a hinge pin.

Referring now to FIG. 7, a side view of another alternate example of a temperature activated door spring as installed with a hinge pin is schematically illustrated. A temperature activated door spring 170 includes a coil 72, a top arm 76, a bottom bracket 77, a pair of opposing bumpers 74, a spring upper arm 73 and a spring lower arm 75 and a snap ring holder 79. The top arm 76 includes a leaf 80 and a pinhole 88. The coil 72, spring upper arm 73 and spring lower arm 75 comprise a contiguous spring device. When installed, a door pin having a top 70 and a shaft 78 is inserted through the coil and snap ring holder 79.

Figure 8:
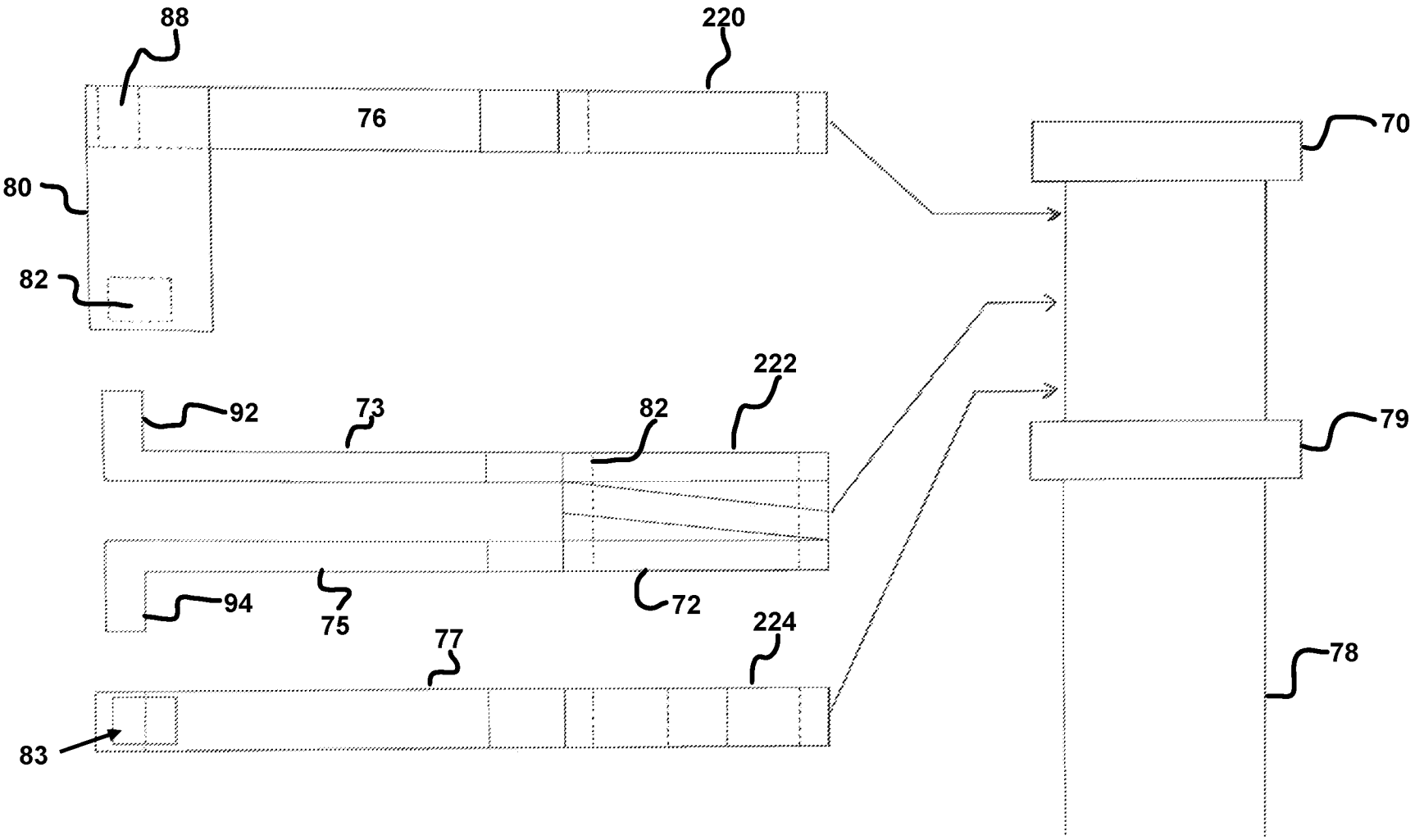
FIG. 8 schematically illustrates an exploded side view of an alternate example of a temperature activated door spring as installed on a hinge pin.
Figure 10:
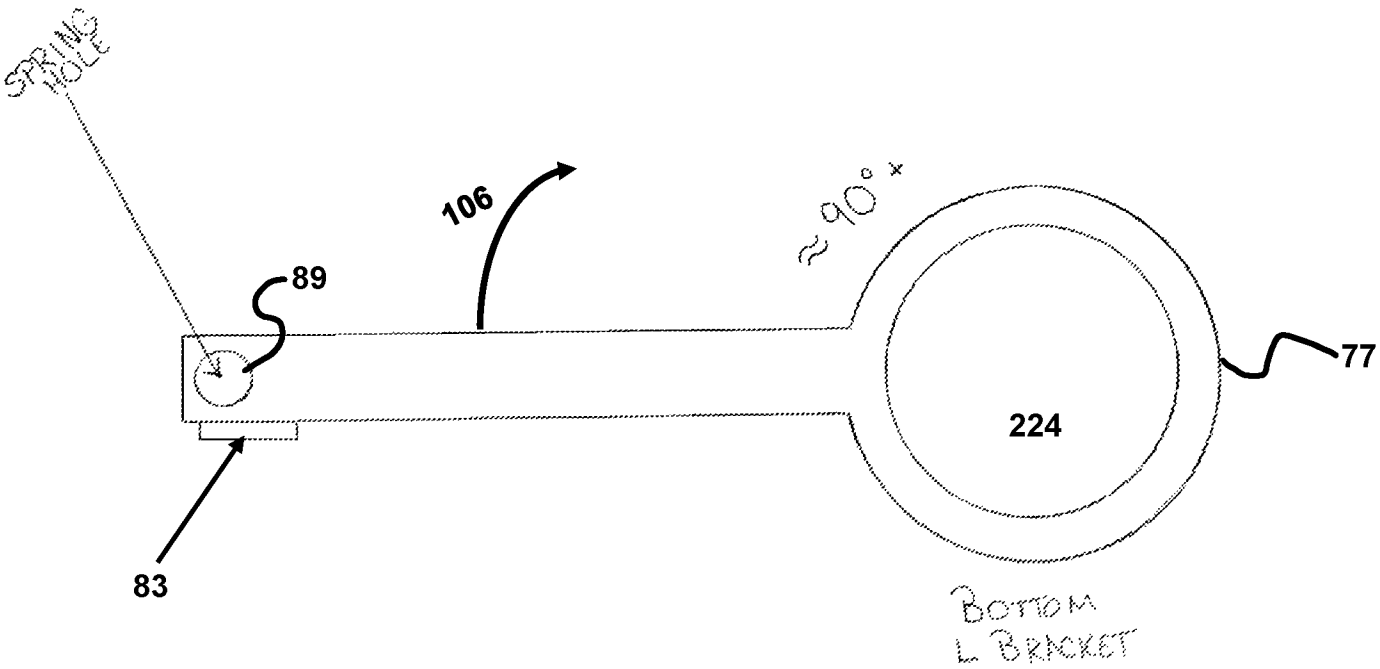
FIG. 10 schematically illustrates a bottom view of a bottom bracket for an alternate example of a temperature activated door spring activation.

Referring now to FIG. 8, an exploded side view of the alternate example of FIG. 7 of a temperature activated door spring as installed on a hinge pin is schematically illustrated. For illustrating the bonding feature, the bumpers 74 have been removed from this illustration. The spring upper arm 73 and spring lower arm 75 each include prongs 92, 94 respectively. The prong 92 is sized to fit into a pinhole 88 in top arm 76. Prong 94 is sized to fit into a similar pinhole 79 (as shown in FIG. 10) in bottom bracket 77. A fusible bond material 83 may be applied to an end of the bottom bracket 77. During manufacture, the fusible bond material 83 is bonded to region 82 of the top arm leaf 80. To accommodate hinge pin 78 insertion, the top arm 76 includes a channel 220, the coil includes a channel 222 and the bottom bracket 77 includes a channel 224. When assembled, the coil 72, the top arm 76, the bottom bracket 77, the spring upper arm 73 and the spring lower arm 75 are captured and held in place between the hinge pin top 70 and the snap ring holder 79.

Figure 9:
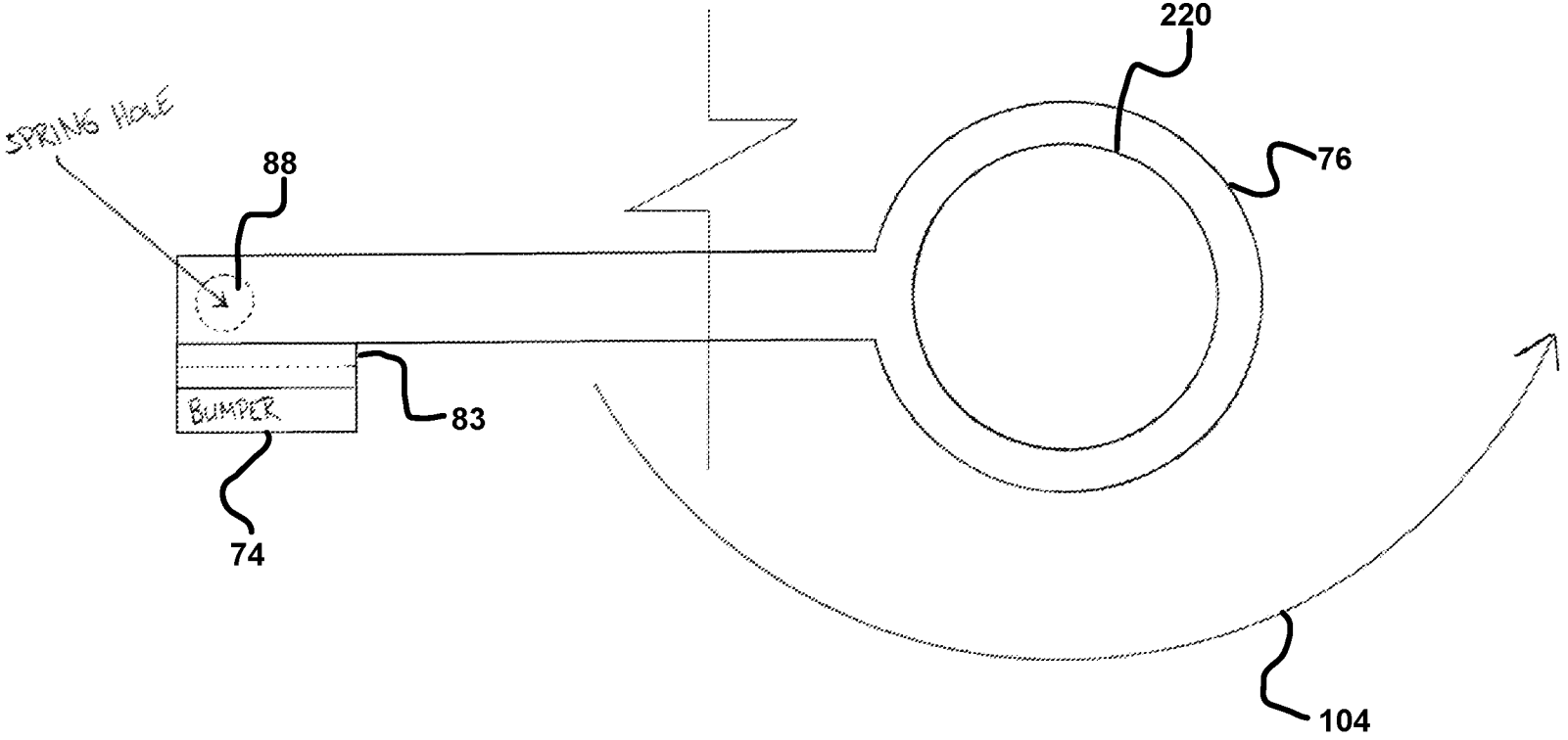
FIG. 9 schematically illustrates a side view of the top arm in an alternate example of a temperature activated door spring activation.

Referring now to FIG. 9, a top view of a top arm used in the alternate example of FIG. 7 for a temperature activated door spring activation is schematically illustrated. The top arm 76 includes a pinhole 88 adapted to accept the prong 92 from the spring upper arm 73. Leaf 83 is affixed between the bumper 74 on one side of the top upper arm 76 at a distance away from the channel 220. Curved arrow 104 represents a force in the direction of pivoting when the bond between the top arm and a bottom bracket melts, thereby releasing the coil spring into an activated position.

Referring now to FIG. 10, a bottom view of a bottom bracket used in the alternate example of FIG. 7 of a temperature activated door spring activation is schematically illustrated. The bottom bracket 77 includes a pinhole 89 adapted to accept the prong 94 from the spring lower arm 75. Pinhole 89 is located proximate the bond 83 on one side of the bottom bracket 77 at a distance away from the channel 224. Curved arrow 106 represents a force in the direction of pivoting when the bond between the top arm and a bottom bracket melts thereby releasing the coil spring into an activated position.

Referring now to FIG. 11, various fusible metals useful for making the fusible pellet and/or a fusible bond are listed. Table 1 lists a plurality of alloys having melting temperatures in the range considered useful for a temperature activated door spring. In one useful example, fusible pellet may comprise a material with a melting point in the range of 107° F.-208° F. In other useful examples, the fusible pellet can be selected from the group consisting of an alloy of bismuth with lead and/or tin, Wood's metal, Rose's metal Field's metal, an alloy of bismuth with lead, tin, indium, cadmium and/or thallium and combinations thereof as shown in Table 1.

Having described the components of a temperature activated door spring, it is considered beneficial to the understanding of the principles herein to describe the operation of the safety mechanism. In one example, the temperature activated door spring operates as a closure mechanism for a door that is actuated during a fire. When activated, the door spring causes the door to automatically close.

The temperature activated door spring may be installed on an existing door hinge and held in place by a hinge pin inserted into knuckles affixed to the hinge. The spring is placed on the door hinge pin, preferably on the upmost hinge knuckle, and then the pin and mechanism is placed in the door hinge. A rotationally tensioned spring holds the temperature activated door spring in a loaded position which is locked-in by a fusible pellet or bond. When installed, the temperature activated door spring is located above the surface of the top hinge knuckle. In a fire, when a predetermined temperature is reached the fusible pellet or bond melts and allows the spring to release. Arms attached to the spring bear against the door and a door frame thereby forcing the door into a closed position. Thus, under ambient temperature conditions the door may be kept open as desired without the need for applying a force such as a doorstop against the door.

Certain exemplary embodiments of the invention have been described herein in considerable detail in order to comply with the Patent Statutes and to provide those skilled in the art with the information needed to apply the novel principles of the present invention, and to construct and use such exemplary and specialized components as are required. However, it is to be understood that the invention may be carried out by different equipment, and devices, and that various modifications, both as to the equipment details and operating procedures, may be accomplished without departing from the true spirit and scope of the present invention.

What is claimed is:

1. A temperature activated door spring device comprising:

a spring having a coil, an upper arm and a lower arm contiguous with the coil;

the coil includes an inner hinge pin hole and has a circumferential edge sized to mount on the top of a hinge knuckle;

a collar affixed within the inner hinge pin hole wherein the inner hinge pin hole is encompassed by the collar and is sized to accept an inserted hinge pin;

a pellet hole located proximate an extended end of the upper arm, wherein the pellet hole is sized to accept a fusible pellet; and wherein an upper portion of the pellet hole traverses through the upper arm and a lower portion of the pellet hole traverses through the lower arm so that when the fusible pellet is inserted into the pellet hole, while the upper arm and lower arm are aligned in a locking position, the fusible pellet holds the upper arm and the lower arm together in a spring loaded position.

2. The device of claim 1 further comprising:

a first bumper attached proximate an outer surface of the upper arm proximate the extended end; and a second bumper attached to an outer surface of the lower arm.

3. The device of claim 1 wherein the upper arm and the lower arm are elongated in a direction generally at a right angle to a central axis projected through the center of the collar.

4. The device of claim 1 wherein the upper arm and the lower arm both include a shoulder to allow the upper and lower arms to substantially abut each other along their interior surfaces.

5. The device of claim 1 wherein the collar is sized with a diameter large enough to accept a hinge pin shaft, but smaller than a hinge pin top so that an inserted hinge pin is held from falling through the hinge pin hole.

6. A temperature activated door spring device comprising:

a spring having a coil, an upper arm and a lower arm contiguous with the coil;

the coil includes an inner hinge pin hole and has a circumferential edge sized to mount on the top of a hinge knuckle;

a collar affixed within the inner hinge pin hole wherein the inner hinge pin hole is encompassed by the collar and is sized to accept an inserted hinge pin;

a pellet hole located proximate an extended end of the upper arm; a fusible pellet inserted into the pellet hole; and wherein an upper portion of the pellet hole traverses through the upper arm and a lower portion of the pellet hole traverses through the lower arm so that when the fusible pellet is inserted into the pellet hole, while the upper arm and lower arm are aligned in a locking position, the fusible pellet holds the upper arm and the lower arm together in a spring loaded position.

7. The device of claim 6 wherein the fusible pellet comprises a material with a melting point in the range of 107° F.-208° F.

8. The device of claim 6 wherein the fusible pellet is selected from the group consisting of an alloy of bismuth with lead and/or tin, Wood's metal, Rose's metal, Field's metal, an alloy of bismuth with lead, tin, indium, cadmium and/or thallium and combinations thereof.

9. The device of claim 6 further comprising:

a first bumper attached proximate an outer surface of the upper arm proximate the extended end; and a second bumper attached to an outer surface of the lower arm.

10. The device of claim 6 wherein the upper arm and the lower arm are elongated in a direction generally at a right angle to a central axis projected through the center of the collar.

11. The device of claim 6 wherein the upper arm and the lower arm both include a shoulder to allow the upper and lower arms to substantially abut each other along their interior surfaces.

12. The device of claim 6 wherein the collar is sized with a diameter large enough to accept a hinge pin shaft, but smaller than a hinge pin top so that an inserted hinge pin is held from falling through the hinge pin hole.

13. The device of claim 6 further comprising a hinge pin inserted into the hinge pin hole.

14. A safety door system comprising:

a doorframe;

a door;

a plurality of hinges pivotally attaching the door to the doorframe, wherein the plurality of hinges each include a plurality of hinge knuckles;

a hinge pin;

a temperature activated door spring device including a spring having a coil, an upper arm and a lower arm contiguous with the coil, wherein the coil includes an inner hinge pin hole and has a circumferential edge sized to mount on the top of a hinge knuckle, a collar affixed within the inner hinge pin hole wherein the inner hinge pin hole is encompassed by the collar and is sized to accept the hinge pin, wherein the hinge pin is inserted into the inner hinge pin hole and a portion of the plurality of hinge knuckles so as to capture the temperature activated spring device between the door and the doorframe;

wherein an upper portion of a pellet hole traverses through the upper arm and a lower portion of the pellet hole traverses through the lower arm so that when a fusible pellet is inserted into the pellet hole, the fusible pellet holds the upper arm and the lower arm together in a spring loaded position; and wherein upon ambient temperature reaching the melting temperature of the fusible pellet, the pellet melts thereby releasing the spring so that the upper arm and lower arm exert a force between the door and the doorframe so as to close the door.

15. The device of claim 14 wherein the fusible pellet comprises a material with a melting point in the range of 107° F.-208° F.

16. The device of claim 14 wherein the fusible pellet is selected from the group consisting of an alloy of bismuth with lead and/or tin, Wood's metal, Rose's metal, Field's metal, an alloy of bismuH1 with lead, tin, indium, cadmium and/or H1allium and combinations thereof.

17. The device of claim 14 further comprising:

a first bumper attached proximate an outer surface of the upper arm proximate the extended end; and a second bumper attached to an outer surface of the lower arm.

18. The device of claim 14 wherein the upper arm and the lower arm are elongated in a direction generally at a right angle to a central axis projected through the center of the collar.

19. The device of claim 14 wherein the upper arm and the lower arm both include a shoulder to allow the upper and lower arms to substantially abut each other along their interior surfaces.

20. The device of claim 14 wherein the collar is sized with a diameter large enough to accept a shaft of the hinge pin, but smaller than a top of the hinge pin so that the hinge pin is held from falling through the hinge pin hole.

* * * * *